United States Patent [19]

Anderson

[11] Patent Number: 4,791,428

[45] Date of Patent: Dec. 13, 1988

[54] MICROWAVE RECEIVING ANTENNA ARRAY HAVING ADJUSTABLE NULL DIRECTION

[75] Inventor: Keith V. Anderson, P.O. Box 800, Black Hawk, S. Dak. 57718

[73] Assignees: Ray J. Hillenbrand; Keith V. Anderson, both of Rapid City, S. Dak.

[21] Appl. No.: 50,605

[22] Filed: May 15, 1987

[51] Int. Cl.[4] ..... H01Q 3/00

[52] U.S. Cl. ..... 343/758; 343/757; 343/844; 343/853

[58] Field of Search ..... 343/757, 758, 882, 844, 343/853

[56] References Cited

U.S. PATENT DOCUMENTS 2,644,158 6/1953 Thrift ..... 343/758

*Primary Examiner*—William L. Sikes
*Assistant Examiner*—Robert E. Wise
*Attorney, Agent, or Firm*—Dorsey & Whitney

[57] ABSTRACT

An antenna array for receiving microwave signals is provided that is particularly designed for use in television receive only (TVRO) satellite earth stations. The array comprises a plurality of identically-directed microwave antenna elements arranged in a plane perpendicular to their common primary receiving direction. Each antenna element includes an integral low-noise amplifier (LNA). Outputs of the LNAs are combined to produce a composite output signal which provides maximum response to microwave radiation arriving from the common primary receiving direction of the elements and null responses to microwave radiation arriving from particular other directions. The array includes means for rotating the elements about an axis parallel to the common primary receiving direction. Such rotation effectively adjusts the angle between the primary receiving direction of the array and a null-response direction disposed in a plane perpendicular to the plane of the array. Interfering microwave signals or noise emanating from a source located in an angular direction that is slightly different from the primary receiving direction of the array can thereby be adjustably nullified by rotating the array about its primary receiving direction axis.

14 Claims, 7 Drawing Sheets

MICROWAVE RECEIVING ANTENNA ARRAY HAVING ADJUSTABLE NULL DIRECTION

FIELD OF THE INVENTION

This invention pertains to television receive-only (TVRO) earth station terminals. In particular, the invention pertains to a practical, cost-effective, TVRO antenna system which is highly responsive to microwave signals arriving from a primary receiving direction but which can adjustably nullify interfering signals and noise arriving from a second direction which differs from the primary receiving direction by a very small angle.

BACKGROUND OF THE INVENTION

Strong consumer interest in home satellite TV reception has motivated research by TVRO system manufacturers into methods for obtaining better performing, more cost-effective, earth station terminals. A TVRO terminal is one component of a typical satellite television system which includes four major components: (1) a television studio where TV signals originate; (2) an up-link station which transmits the TV signal into space; (3) a communications satellite in geostationary orbit which receives the up-linked signal and retransmits it to earth at a down-link microwave frequency; and (4) a TVRO terminal to receive the down-linked microwave signal and convert it into audio and video information for display.

The TVRO earth station terminal itself includes six major components: (1) a directional receiving antenna directed at the desired satellite; (2) a low-noise preamplifier (LNA) mounted directly on the directional antenna; (3) a frequency down-converter; (4) a satellite TV receiver; (5) a VHF remodulator; and (6) a conventional VHF television set.

At the present time, communications satellites rebroadcasting TV signals from geostationary orbits in the Clarke belt are spaced apart by approximately four degrees of longitude. Such close angular spacing places severe requirements on the TVRO earth station microwave antenna. In order to satisfactorily discriminate against interference from satellites that are adjacent to the satellite being received, antennas having high directivity and correspondingly narrow beamwidths are required. Satisfying these requirements with conventional parabolic "dish" antennas dictates the use of reflectors having very large diameters. Accordingly, reflecting dishes having diameters as large as 15 feet are not uncommon in home TVRO satellite systems.

The problem of discriminating against interference from adjacent satellites will soon be exacerbated. Proposals are currently pending before the Federal Communications Commission to increase the number of operating TV satellites by reducing their angular separation to approximately two degrees of longitude. With 2.00 degree longitudinal separation, earth stations near the equator would "see" adjacent satellites directly overhead separated by only 2.35 azimuthal degrees; and those near the poles would "see" the satellites near the horizon separated by azimuthal angles of only slightly more than 2.00 degrees. Serious questions arise as to whether even 15-foot diameter dishes will be sufficiently directive to satisfactorily discriminate between adjacent satellites having such close angular spacing. Clearly, there is considerable current and future need for a small, cost-effective, microwave antenna system that is highly responsive to signals arriving from a primary receiving direction but which can effectively nullify signals and noise arriving from another direction that differs from the primary receiving direction by only a very small angle.

SUMMARY OF THE INVENTION

The microwave receiving antenna array in accordance with the present invention provides a practical, cost-effective, solution to the problem of discriminating against small-angle, off-axis, interference and noise. It accomplishes this result without resorting to the use of a large diameter reflector as would be required by the conventional approach to this problem.

The receiving antenna array hereof comprises a plurality of directional antenna elements, such as, e.g., small parabolic dish antennas, arranged in a common plane and directed in a common direction perpendicular to that plane. Each of the antenna elements includes an integral low-noise amplifier (LNA). The outputs of each of the LNAs are combined to produce a composite output signal which provides maximum response to microwave radiation arriving from the common primary receiving direction of the elements and null responses to microwave radiation arriving from particular other directions. The array includes means for rotating the plurality of elements about an axis parallel to their common primary receiving direction. Such rotation effectively adjusts the angle between the primary receiving direction of the array and a null-response direction disposed in a plane perpendicular to the plane of the array. Interfering microwave signals or noise emanating from a source located in an angular direction that is slightly different from the primary receiving direction of the array can thereby be adjustably nullified by rotating the array about its primary receiving direction axis.

DETAILED DESCRIPTION OF THE DRAWINGS

Figure 1:
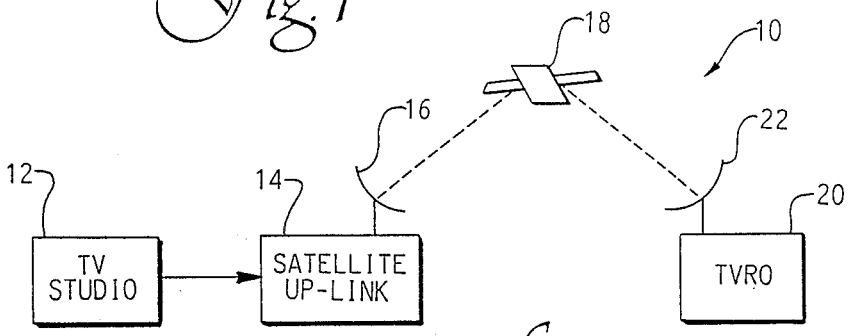
FIG. 1 is a block diagram of a satellite television communication system.

Referring now to the drawings, a standard satellite television system will first be described in a general manner to enhance the understanding of one particular application for the microwave receiving antenna array disclosed herein.

Referring first to FIG. 1, the four major parts of a satellite TV communication system 10 are depicted in block diagram format. A typical satellite television system 10 includes a television studio 12 where TV signals are generated, an up-link earth station 14 including transmitting antenna 16, a communication satellite 18 disposed above the equator in the Clarke belt in a geostationary orbit, and a down-link station comprising a television receive-only (TVRO) earth terminal 20 including a microwave receiving antenna 22. The transmitting and receiving antennas 16 and 22 are each directional antennas directed at the satellite 18.

Figure 2:
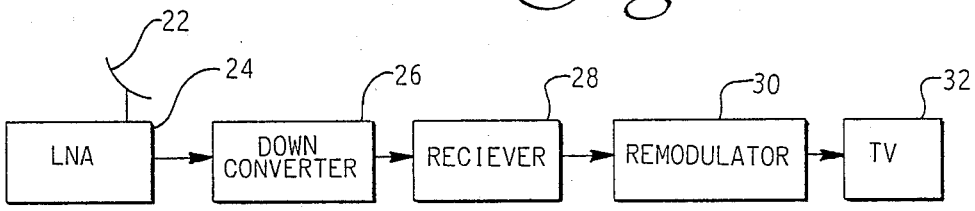
FIG. 2 is a block diagram of a television receive only (TVRO) earth station terminal component of a television satellite communication system.

Referring next to FIG. 2, a typical TVRO earth station terminal is depicted in block diagram format. The TVRO terminal 20 includes a microwave receiving antenna 22, low noise amplifier (LNA) 24, down convertor 26, receiver 28, remodulator 30, and a conventional TV console display 32.

The receiving antenna 22 conventionally comprises a single parabolic reflector antenna element having a feedhorn at the reflector's focus. Such antennas are characterized by having directivity that is proportional to the aperture area of the parabolic reflector and primary beamwidth that is inversely proportional to this area. Accordingly, large aperture areas are generally required to obtain high directivity and narrow primary beamwidth with conventional single-element parabolic reflector antennas. To satisfy present system requirements, the diameters of conventional parabolic reflector antennas in common use in TVRO systems typically vary from about 8 feet to about 15 feet. These diameters correspond to aperture areas varying from about 50 square feet to about 177 square feet. The microwave receiving antenna 22 of a TVRO earth station terminal 20 is generally mounted on a base that permits angular adjustment of both azimuth and elevation. The primary receiving direction of the antenna can thereby be precisely aligned with a direction vector pointing to the selected satellite.

The low noise amplifier (LNA) 24 comprises an extremely sensitive microwave transistor amplifier that can amplify extraordinarily weak signals received from satellite 18 without introducing excessive self-generated noise. The need for low-noise amplification will be appreciated by noting that microwave signals received from a satellite 18 by a microwave receiving antenna 22 are typically less than one-millionth as strong as signals received from a conventional television broadcast station by an ordinary television receiver. To benefit most fully from the low-noise amplification capability of LNA 24, it is imperative that transmission line losses arising between the microwave receiving antenna and LNA 24 be kept very small. Accordingly, LNA 24 is generally mounted directly on microwave receiving antenna 22 as close to its feedhorn as possible.

Figure 3:
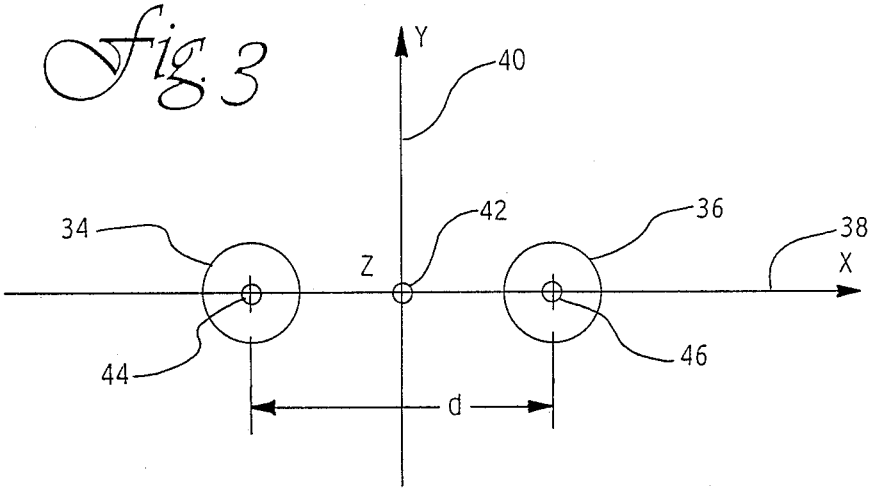
FIG. 3 is a simplified planar representation of one embodiment of the invention comprising a linear array of two receiving antenna elements arranged along the x-axis of an orthogonal xyz coordinate system and directed to the z-direction.

Referring now to FIG. 3, a two-element array of identical receiving antenna elements in accordance with the present invention is depicted in schematic form. Directional receiving antenna elements 34 and 36 are arranged along the x-axis 38 of an orthogonal xyz coordinate system represented with its x-axis 38 an y-axis 40 in the plane of the paper and its z-axis 42 pointing out of the plane of the paper. The respective centers of antenna elements 34 and 36 are spaced a distance d apart and are equidistant from the z-axis 42. Directional antenna elements 34 and 36 are assumed to be oriented such that their primary receiving direction vectors, 44 and 46, respectively, are co-parallel and mutually aligned with the z-axis 42. According to the present invention, the z-axis 42 serves as a rotation axis as will be fully explained herein below.

Figure 4:
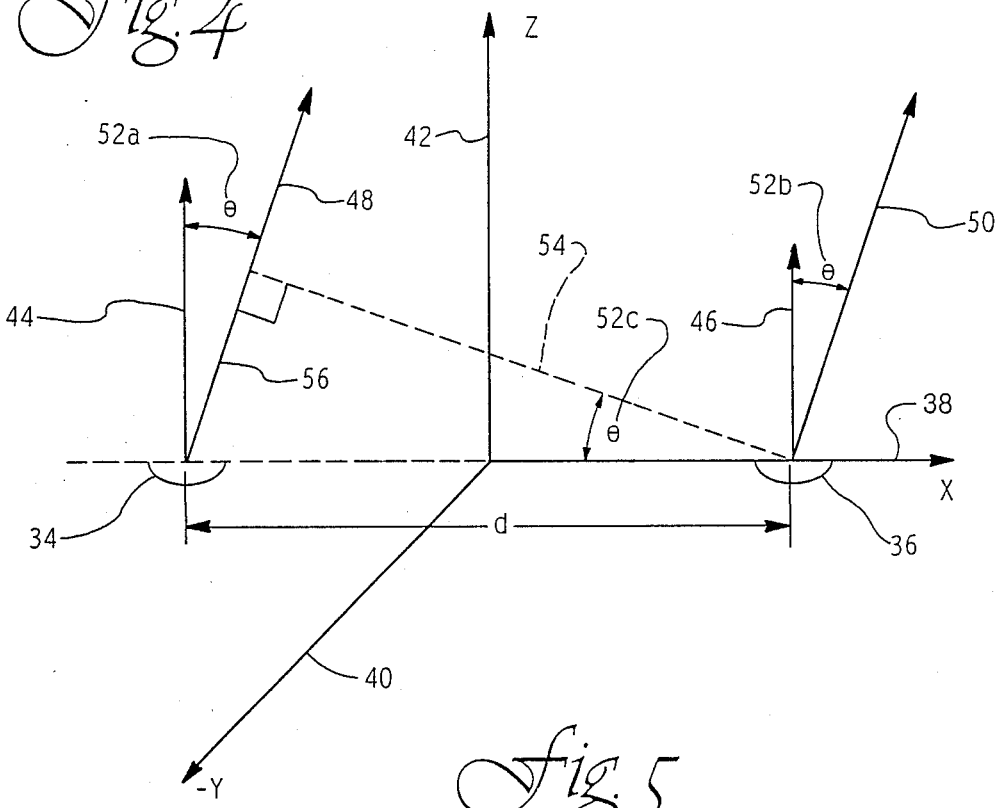
FIG. 4 is a simplified isometric representation of the array depicted in FIG. 3 showing parallel vectors directed from each antenna element to a very far distant point in space.

FIG. 4 presents an isometric view of the linear two-element receiving antenna array of FIG. 3. Directed line segments 48 and 50 represent vectors pointing from the centers of antenna elements 34 and 36, respectively, to a single, very far distant, point in space disposed in the x-z plane. Vectors 48 and 50 are therefore themselves disposed in the x-z plane. Furthermore, by virtue of the fact that vectors 48 and 50 are each directed toward a common point at great distance, vectors 48 and 50 are essentially co-parallel. Accordingly, vector 48 forms the same size angle 52*a* with primary receiving direction vector 44 as the angle 52*b* vector 50 forms with primary receiving vector 46.

Again referring to FIG. 4, a right triangle can be formed by extending a straight line segment 54 in the x-z plane from the center of antenna element 36 to vector 48 in such manner as to intersect vector 48 at right angles. The size of included angle 52*c* between line segment 54 and the x-axis 38 is then the same size as the angles 52*a*, 52*b* between vectors 44 and 48 and vectors 46 and 50. The length of the triangle's side 56 opposite to the included angle 52*c* represents the difference between propagation path distances from the very far distant common point in space to the centers of the two individual antenna elements, 34 and 36, respectively. Using trigonometric considerations, this path length difference can be written:

$$p_1 - p_2 = d \text{ SIN } \theta \quad (1)$$

where $\theta$ is defined to be the size of the angle between the z-axis 42 and a vector directed toward the very far distant point in space in the x-z plane, it being understood that angles 52*a*, 52*b*, and 52*c* are also $\theta$.

Figure 5:
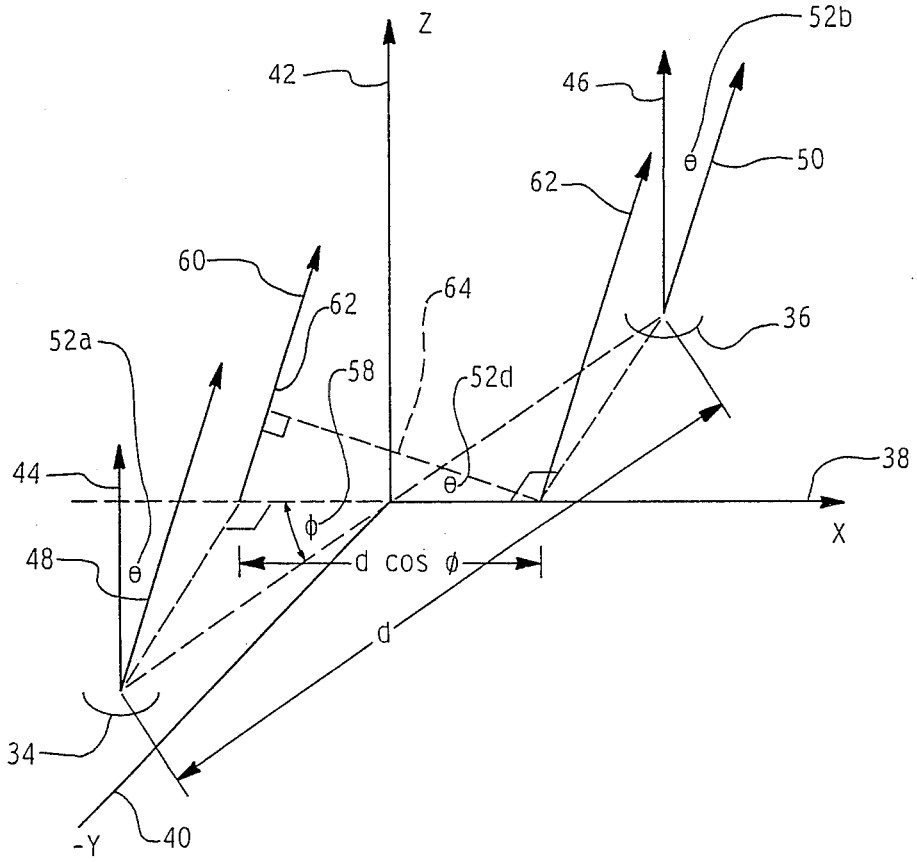
FIG. 5 is similar to FIG. 4, but with the array moved away from the x-axis in the x-y plane by a rotation about the z-axis.

Referring now to FIG. 5, an isometric view of the two-element array is presented in which the antenna elements have been moved away from the x-axis 38 by rotating the array about the z-axis 42 through a rotation angle 58. The antenna elements remain in the x-y plane but are no longer disposed in the x-z plane. Vectors 48 and 50 remain essentially co-parallel and identically directed after this rotation because they are both pointing at the same far distant point in the x-z plane. Thus, the angle 52*a* formed by the intersection of vectors 44 and 48 remains the same size as the angle 52*b* formed by the intersection of vectors 46 and 50 and is unchanged by this rotation. In addition, the projection of vector 48 in the x-z plane, vector 60, and the projection of vector 50 in the x-z plane, vector 62, are likewise co-parallel to vectors 48 and 50 and form the same size angle 52*d* with the z-axis 42 as before the rotation. Accordingly, the length of side 62 of the triangle in the x-z plane formed by extending straight line segment 64 from the intersection of vector 62 and x-axis 38 to meet vector 60 at right angles represents the difference between the lengths of propagation paths from the far distant common point in space to the centers of the two individual antenna elements, 34 and 36, respectively. The hypotenuse of this triangle is equal to d COS $\phi$, where $\phi$ is the size of angle 58. Thus, using the same trigonometric considerations that led to equation (1), the difference between the propagation path lengths to centers of individual antenna elements 34 and 36 is now written:

$$p_1 - p_2 = d \text{ COS } \phi \text{ SIN } \theta \tag{2}$$

where $\theta$ is defined to be the size of the angle between the z-axis 42 and a vector directed toward the far distant point in space in the x-z plane, and $\phi$ is defined to be the size of the angle of rotation of the array about the z-axis 42.

Figure 6:
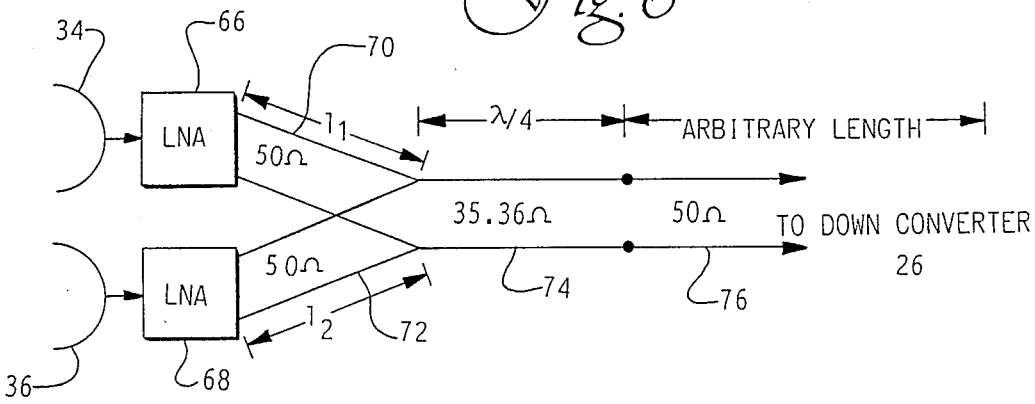
FIG. 6 is a transmission-line connection diagram depicting one method for combining signals received by individual antenna elements in a two-element receiving antenna array such as that depicted in FIG. 5.

Referring now to FIG. 6, a transmission line connection diagram is presented which depicts one method for combining signals received by the two antenna elements of the array depicted in FIG. 5. The output of antenna element 34 is connected to the input of LNA 66 which is preferably mounted very near the feedpoint of antenna element 34 to make the interconnecting link as short as possible. Similarly, the output of antenna element 36 is connected to the input of LNA 68 which is preferaebly mounted very near the feedpoint of antenna element 36 to make that interconnecting link as short as possible. The output of LNA 66 is connected to a transmission line 70 of length $l_1$, and the output of LNA 68 is connected to a transmission line 72 of length $l_2$. Transmission lines 70 and 72 are normally of identical construction and possess characteristic impedances which match the output impedances of LNA 66 and LNA 68. Transmission lines 70 and 72 would normally comprise conventional 50 ohm coaxial cable. Transmission line lengths $l_1$ and $l_2$ are appropriately chosen to make the total electrical phase shift from the feedpoint of antenna element 34 to the output of transmission line 70 exactly the same as the total phase shift from the feedpoint of antenna element 36 to the output of transmission line 72. Most commonly, this equal phase shift condition would be realized with $l_1 = l_2$.

Continuing to refer to FIG. 6, the outputs of transmission lines 70 and 72 are combined in parallel and connected to the input of transmission line 74. Transmission line 74 has length equal to one-quarter wavelength. The output of transmission line 74 is connected to the input of transmission line 76 which leads to the input of down converter 26. Transmission line 76 is of arbitrary length and its characteristic impedance matches the input impedance of down converter 26. Transmission line 76 would also normally comprise conventional 50 ohm coaxial cable. As will be well understood by one skilled in the art, the quarter-wavelength section of transmission line 74 serves as a matching transformer between the impedance levels at its input and output ends. A correct impedance match results when the characteristic impedance of transmission line 74 is equal to the geometric mean between the impedances terminating its two ends. Assuming that LNA 66, LNA 68 and down converter 26 each present 50 ohm impedance levels and that transmission lines 70, 72, and 76 have characteristic impedances of 50 ohms, the appropriate characteristic impedance of transmission line 74 is 35.36 ohms.

The interconnection method of FIG. 6 effectively combines equally phase-shifted outputs of LNA 66 an LNA 68 in parallel while maintaining a proper impedance match through the use of a quarter-wavelength transmission line. As will be appreciated by those skilled in the art, other equivalent methods for accomplishing these ends are possible. For example, equally phase-shifted LNA outputs could be combined in series rather than in parallel; and other impedance transformation techniques such as those employing magnetic coupling could be utilized to maintain a proper impedance match.

By virtue of the method depicted in FIG. 6 for combining signals received by antenna element 34 and antenna element 36, currents induced at the summing point by microwave radiation arriving at the antenna elements from a common source in the primary receiving direction of the elements will be of equal amplitude and in phase with one another. They will therefore simply add at the junction of the transmission lines 70 and 72. Accordingly, the primary receiving direction of the elements, the z-direction, is also the primary receiving direction of the array. However, the composite signal entering transmission line 76 will be nullified for microwave signals which arrive simultaneously at antenna elements 34 and 36 with equal amplitudes but opposite phases. Thus, if the total propagation path distance from the point of origin to the two antenna elements is an odd multiple of one-half wavelength, the composite microwave signal will be nullified. By applying this result to equation (2), one obtains the following null condition for the two-element linear receiving array of FIG. 5:

$$d \text{ COS } \phi \text{ SIN } \theta = (2n+1)\lambda/2 \tag{3}$$

where n=0, 1, 2, . . .

By letting n=0 while noting that the wavelength of satellite TV signals in the C-band (4 GHz) is very nearly 3 inches, one obtains:

$$d \text{ COS } \phi \text{ SIN } \theta = 1.5 \text{ inches} \tag{4}$$

as the condition appropriate to the primary null angle for C-band microwave signals.

Equation (4) reveals several important advantages of the present invention. First of all, by letting $\phi = 0$ and d=43 inches, one obtains $\theta = 2$ degrees as the primary null angle in the x-z plane for two antenna elements arrayed along the x-axis. By choosing the separation distance d to be larger than 43 inches, even smaller angular separations between the primary receiving direction and the primary null direction can be obtained. Furthermore, this dramatic beam narrowing is totally independent of the aperture area of the individual antenna elements. The present invention therefore makes possible very effective differentiation between two very closely spaced satellites using only a small, cost effective, microwave antenna system.

Figure 7:
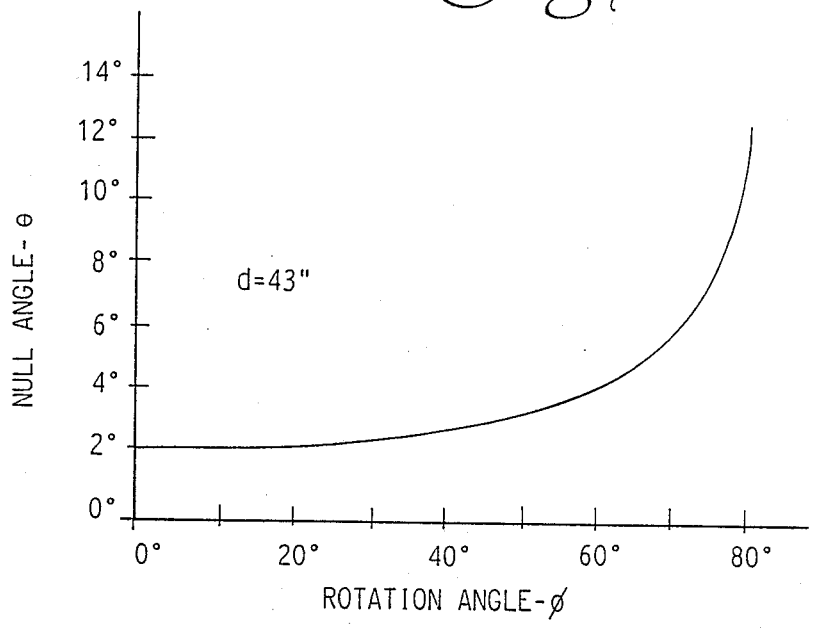
FIG. 7 is a graphical plot of the primary null angle in the x-z plane for the two-element array of FIG. 5 as a function of the angle of rotation of the array about the z-axis for an element spacing of 43 inches.

A second important advantage can be seen by permitting the array rotation angle $\phi$ to vary in equation (4) while calculating the null angle $\phi$ for a constant element spacing d. FIG. 7 is a graphical plot of the primary null angle in the x-z plane as a function of the angle of rotation about the z-axis, assuming a center-to-center element spacing of 43 inches. One sees that the null angle increases from a minimum of 2 degrees as the rotation angle $\phi$ increases. For example, at a rotation angle of 60 degrees, the null angle has doubled to 4 degrees. Such rotation of the array about its z-axis can therefore be employed as means to effectively adjust the null angle. By taking appropriate advantage of this principle, interfering signals and noise arriving from a direction which differs from the primary receiving direction by only a small angle can be very precisely adjustably nullified.

Figure 8:
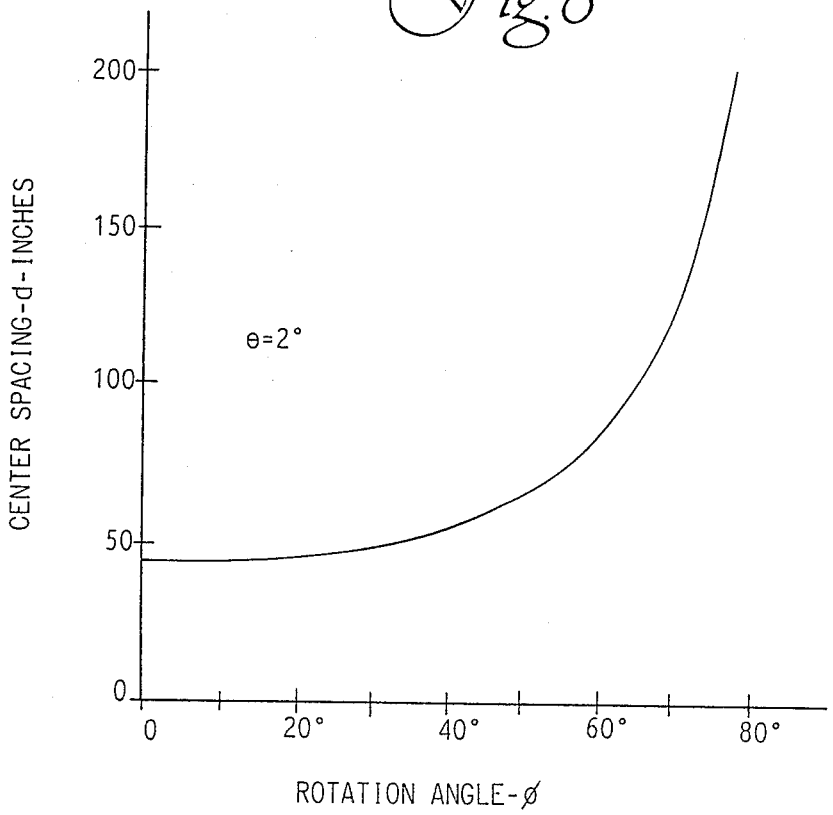
FIG. 8 is a graphical plot of element spacing for the two-element array of FIG. 5 as a function of the angle of rotation of the array about the z-axis for a primary null angle of two degrees in the x-z plane.

A third important advantage can be seen by permitting the array rotation angle $\phi$ to vary in equation (4) while calculating the center-to-center element spacing d appropriate to a fixed primary null angle $\theta$. FIG. 8 is a graphical plot of center-to-center element spacing as a function of the angle of rotation about the z-axis appropriate to a fixed primary null angle in the x-z plane of 2 degrees. One sees that the center-to-center element spacing increases from a minimum of 43 inches as the array is rotated away from the x-axis. The present invention therefore permits one to employ individual elements having diameters larger than 43 inches and still realize a primary null angle of 2 degrees by simply rotating the array away from the x-axis. Since the power gain of the array increases in proportion to the total aperture area of the elements, this is a very effective way of obtaining increased power gain while still maintaining a particular null angle. For example, by rotating the array through a 60 degree angle, the total aperture area, and hence the antenna system's power gain, can be increased by a factor of four even though the primary null angle in the x-z plane remains 2 degrees.

Figure 9:
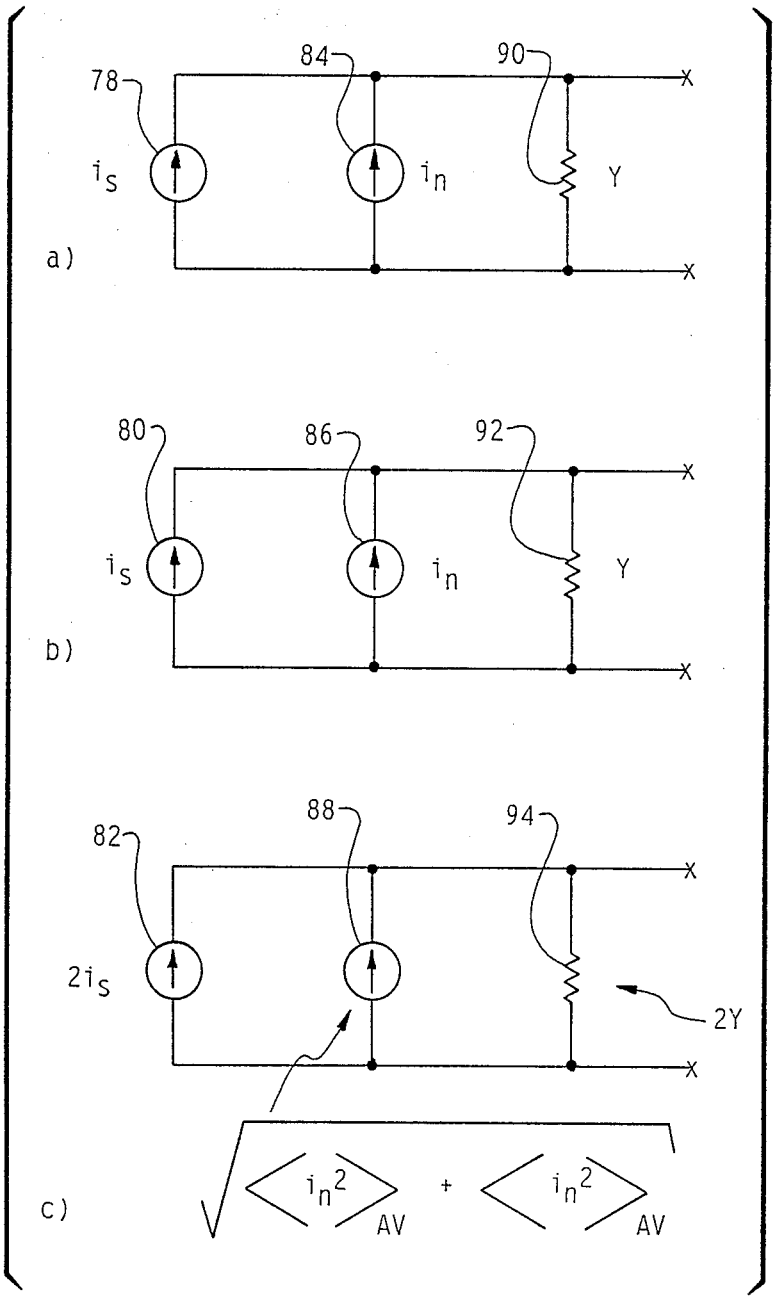
FIG. 9 is schematic diagram depicting Norton's Theorem equivalent circuits of the outputs of the individual LNAs and of the combined output of the two LNAs connected in parallel according to the circuit of FIG. 6.

A fourth important advantage of the present invention can be appreciated by considering the manner in which signal currents and noise currents combine in the signal combining circuit of FIG. 6. Referring to FIG. 9, Norton's Theorem equivalent circuits are represented for (a) the output of transmission line 70 taken along; (b) the output of transmission line 72 taken along; and (c) the combined output of transmission lines 70 and 72 connected in parallel. One sees that each equivalent circuit comprises a signal current source 78, 80, and 82, respectively; a noise current source 84, 86 and 88, respectively; and an admittance 90, 92, and 94, respectively. The admittances of the two identical circuits simply add. Thus, the admittance 94 of the combined circuit is simply twice the individual admittances 90 or 92. Similarly, the signal currents 78 and 80 are fully correlated with one another and simply add together to form a resultant signal current 82 that is twice the individual currents 78 and 80. Noise currents 84 and 86 arise predominantly from noise generated within the individual LNAs 66 and 68. These currents are totally uncorrelated with one another and therefore add quadratically. That is, their mean-squared values add rather than their instantaneous values. Accordingly, the root-mean-squared (RMS) value of the resultant noise current 88 is the square root of the sum of the mean-squared values of the individual noise currents 84 and 86 as shown in FIG. 9.

The signal to noise ratio, (S/N), is defined to be the available signal power divided by the available noise power and is equal to the square of the ratio of RMS signal current to RMS noise current at the combining point. For each of the individual LNA outputs represented by equivalent circuits (a) and (b), the signal to noise ratio is therefore written:

$$(S/N)_1 = \frac{i_s^2}{\langle i_n^2 \rangle_{AV}} \tag{5}$$

For the combination circuit represented by equivalent circuit (c), the signal to noise ratio is:

$$(S/N) = \frac{(2i_s)^2}{2\langle i_n^2 \rangle_{AV}} = \frac{2i_s^2}{\langle i_n^2 \rangle_{AV}} \tag{6}$$

Thus, by comparing equations (5) and (6), one concludes that the signal to noise ratio of the composite signal resulting from combining outputs of the two LNAs is improved by a factor of two over the signal to noise ratios existing at the outputs of the individual LNAs. This important improvement in signal to noise ratio is a direct consequence of the fact that signal currents add directly in the combining circuit of FIG. 6 while noise currents add only quadratically. This very significant improvement in signal to noise ratio will be realized by the present invention in spite of the fact that the microwave signals are combined after the noise has already been introduced into the signal stream by the LNAs.

Figure 10:
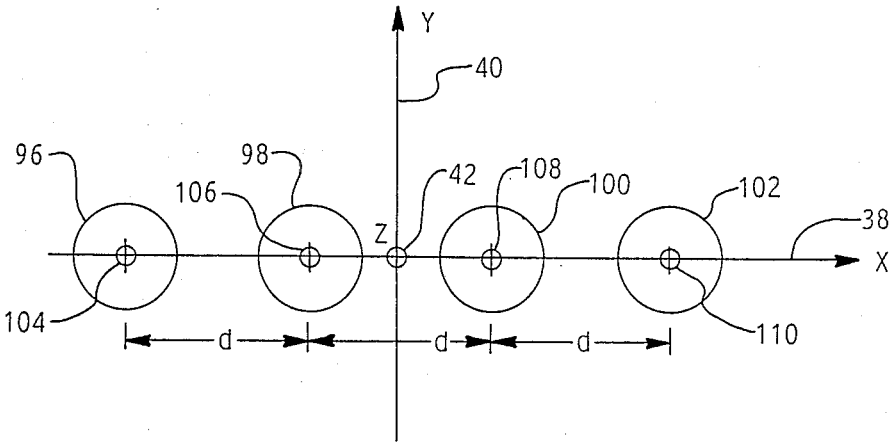
FIG. 10 is a simplified planar representation depicting a second embodiment of the invention comprising a linear array of four receiving antenna elements arranged along the x-axis of an orthogonal xyz coordinate system and directed in the z-direction.

Referring next to FIG. 10, a second embodiment of the invention is depicted comprising a four-element linear array of receiving antenna elements 96, 98, 100, and 102 arranged along the x-axis 38. The four identical elements are equally spaced having common center-to-center distances d and are symmetrically arranged with respect to the origin of the xyz coordinate system. As in the simpler two-element linear array depicted in FIG. 3, antenna elements 96, 98, 100, and 102 are assumed to be oriented such that their primary receiving direction vectors, 104, 106, 108, and 110 respectively, are co-parallel and mutually aligned with the z-zxis 42. The z-axis 42 again serves as both the primary receiving direction vector of the array and as a rotation axis for adjusting the angle between the primary receiving direction and the primary null direction in the x-z plane.

Operation of the four element linear receiving antenna array can be most easily understood by grouping the elements in pairs. If elements 96 and 98 are considered together and if elements 100 and 102 are considered together, vector diagrams identical to those depicted in FIGS. 4 and 5 can be drawn for each pair of elements. Consequently, equations (1) and (2) will apply equally well to each pair of elements in the four element array as to the single pair of elements of the two-element array. Means for appropriately combining the outputs of the individual elements will be described herein below. Assuming that the signal outputs of the individual elements are appropriately combined in proper phase relationship, one will then obtain the same primary null condition for the four-element array as for the two element array, namely equation (4). In fact, this same reasoning can be extended to any linear array, no matter how large, as long as the receiving antenna array has an even number of equally spaced identical elements and as long as their outputs are appropriately combined in proper phase relationship. All such arrays will have primary null conditions described by equation (4).

All of the benefits set forth above for the two-element linear array of FIG. 3 will therefore also apply to the four-element linear array of FIG. 10. In particular, the four-element array also provides simple, cost-effective, means for effectively differentiating between two very closely spaced satellites without resorting to large diameter reflectors. In addition, an interfering signal from an adjacent satellite can be adjustably precisely nullified by rotating the array about an axis parallel to the array's primary receiving direction. The power gain of the array can be increased while the null angle is still maintained at a particular value by rotating the array away from the x-axis and then increasing the diameter of the individual elements to the new maximum value permitted by the increased center-to-center separation distance. In this regard, the maximum power gain of the four-element linear array will always be twice that of the two-element array because the maximum aperture area is twice as large. Finally, since signal currents combine linearly while noise currents combine quadratically, the four-element array enjoys a factor two advantage in signal to noise ratio in comparison with a two-element array of equivalent elements and a factor four advantage in comparison with a single equivalent element. This advantage again accrues in spite of the fact that the microwave signals are combined after the noise has already been introduced into the signal stream by the LNAs.

Figure 11:
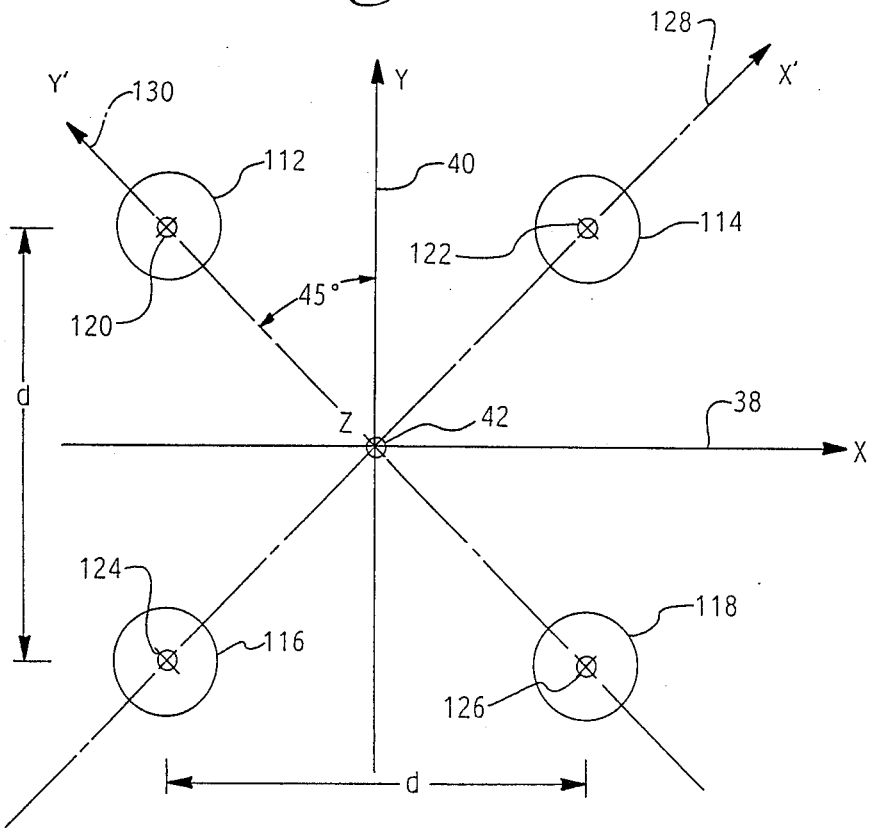
FIG. 11 is a simplified planar representation depicting a third embodiment of the invention comprising a planar array of four receiving antenna elements arranged at the corners of a square disposed in the x-y plane and directed in the z-direction.

Referring now to FIG. 11, a third embodiment of the invention is depicted comprising a two-dimensional array of four identical antenna elements, 112, 114, 116, and 118 arranged in the x-y plane at the corners of a square of side d. The individual antenna elements are again assumed to be oriented such that their primary receiving direction vectors, 120, 122, 124, and 126, respectively, are co-parallel and mutually aligned with the z-axis 42. The z-axis again serves as both the primary receiving direction vector of the array and as a rotation axis for adjusting the angle between the primary receiving direction and a primary null direction. However, unlike the linear array embodiments described above, the primary null angle in a fixed plane is not continuously adjustable by rotation of the array about the z-axis 42. Indeed, perfect null response in a fixed plane perpendicular to the plane of the array is only obtained for certain discrete values of the rotation angle. As will be shown below, one of eight perfect null responses can be obtained by appropriate rotation about the z-axis. Although the off-axis response does not go exactly to zero for rotation angles in-between these discrete rotation angles, the off-axis response is greatly diminished.

The planar array of FIG. 11 has two fundamentally different modes of signal cancellation. For signals arriving from a far distant point in either the x-z plane or the y-z plane, the primary null response occurs when the path lengths to the two nearest elements is one-half wavelength less than the path lengths to the two farthest elements. For example, with an off-axis signal source in the x-z plane at a positive x-value in FIG. 11, primary cancellation will occur when the path lengths to elements 114 and 118 are one-half wavelength less than the path lengths to elements 112 and 116. Similar reasoning may be applied to an off-axis signal source in the xz-plane at negative x or in the yz-plane at either positive or negative y-values. There are therefore four discrete nulls of this type occurring every 90 degrees as the array is rotated about the z-axis. The null conditions for this mode of cancellation are similar to the cancellation conditions for a two-element array and can be written:

$$d \text{ SIN } \theta = 1.5 \text{ inches} \tag{7}$$

for C-band microwave signals, where $\theta$ is the size of the angle between the z-axis 42 and a vector directed toward the very far distant point in the x-z plane.

FIG. 11 also shows two orthogonal x' and y' axes, 128 and 130, respectively, disposed in the same plane as the x and y axes but rotated therefrom by 45 degrees. The second, fundamentally different mode of signal cancellation occurs for signals arriving from a far distant point in either the x'-z plane or the y'-z plane. For such signals, total cancellation will occur when the signals arriving at the nearest and farthest elements are in phase with each other but out of phase with the signals arriving at the two elements of intermediate distance. Consider, for example, the effect of signals arriving from a far distant source in the x'-z plane at positive x' in FIG. 11. The two antenna elements on the y'-axis, elements 112 and 118, are equidistant from this source. Accordingly, signals arriving at these two elements will always be in phase with each other. Total cancellation can therefore only occur if these two in-phase signals are 180 degrees out of phase with the signals arriving at elements 114 and 116 on the x'-axis, which, in turn must therefore be in phase with each other. The propagation path lengths from the far distant point to the near and far elements, 114 and 116, must therefore differ by a full wavelength to obtain perfect null response. Such considerations lead to the following null condition for this mode of cancellation:

$$d \text{ SIN } \theta = 2.12 \text{ inches} \tag{8}$$

for C-band microwave signals.

Assuming an array having d=43 inches, the primary null angle according to equation (7) occurs at 2.0 degrees and that according to equation (8) occurs at 2.83 degrees. Thus, as the array is rotated about its z-axis, perfect primary nulls will occur every 45 degrees of rotation and will oscillate between 2.0 degrees off-axis and 2.83 degrees off-axis. Although total cancellation will not occur for arbitrary rotation angles between the 45 degree intervals, the response to off-axis signals will be greatly diminished in this range.

The planar array depicted in FIG. 11 has the advantage of providing null responses in more than one plane. The elements in the array disclosed are arranged in the form of a square which leads to identical null angles in orthogonal planes. That is, the null angle in x-z plane is the same as the null angle in the y-z plane and the null angle in the x'-z plane is the same as the null angle in the y'-z plane. Other arrangements are possible which would lead to different null angles in orthogonal planes.

For example, a rectangular arrangement of elements would negate the second mode of cancellation described above but would produce null responses in the x-z and y-z planes having different null angles. Similarly, an elongated diamond shape would negate the first mode of cancellation described above but would produce null responses in the x'-z and y'-z planes having different null angles. As with the linear four-element array, the power gain and the signal to noise ratio of the planar four-element array will each be increased by a factor two in comparison with those quantities appropriate to a two-element array comprised of equivalent elements.

Figure 12:
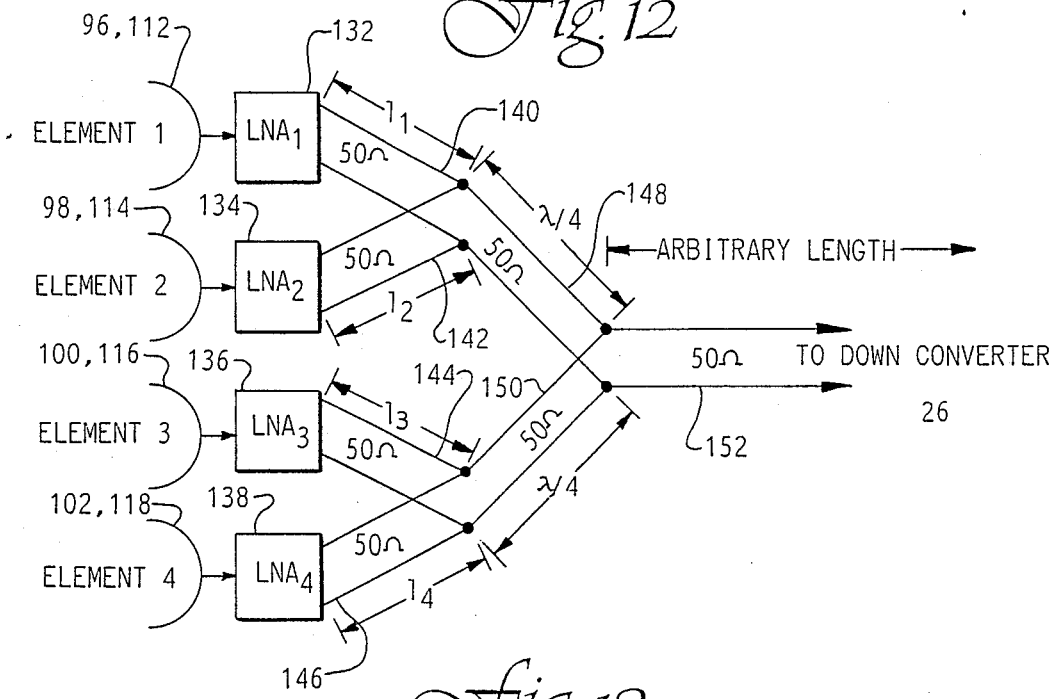
FIG. 12 is a transmission-line connection diagram depicting one method for combining signals in four-element receiving antenna arrays such as those depicted in FIG. 10 and FIG. 11.

Referring now to FIG. 12, a transmission line interconnection diagram is presented depicting one method for combining signals received by the four antenna elements of either the linear four-element array depicted in FIG. 10 or the planar four-element array of FIG. 11. This interconnection method has the desirable property of utilizing only transmission lines having a single characteristic impedance value. This value would normally be 50 ohms. As depicted in FIG. 12, the outputs of transmission lines 140 and 142, interfacing respectively with LNA 132 and 134, are connected in parallel as are the outputs of transmission lines 144 and 146, interfacing respectively with LNA 136 and 138. The lengths of these four transmission lines are chosen such that the total phase shifts from antenna elements to summing points are all equal. Normally the four transmission lines would be of equal length. Each parallel combination of two transmission lines is connected to the input of a quarter-wavelength section of transmission line, 148 and 150, respectively. The outputs of transmission lines 148 and 150 are then connected in parallel and applied to the input of transmission line 152 which can be of arbitrary length. Since the characteristic impedances of the quarter-wavelength sections, 148 and 150, are the geometric means of the impedance levels at their ends, each line transforms the value of one-half the common characteristic impedance at its input side into twice the common characteristic impedance at its output side. The outputs of the two quarter-wavelength lines are thereupon combined in parallel to obtain an impedance level equal to the common characteristic impedance. This results in a perfect impedance match with transmission line 152.

Figure 13:
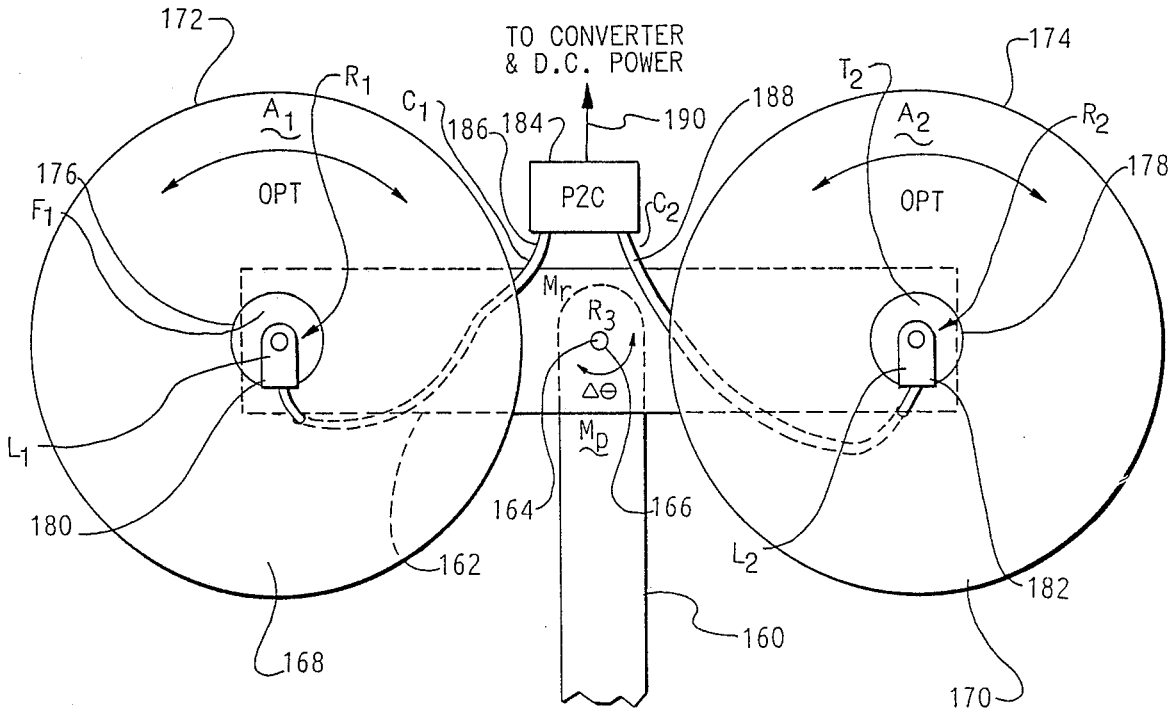
FIG. 13 is an elevational view of a two-element linear receiving antenna array in accordance with the present invention.

Referring now to FIG. 13, a first practical embodiment of a microwave receiving antenna array in accordance with the present invention will be described in detail. FIG. 13 discloses a physically small antenna system particularly suitable for TVRO earth station use that is extraordinarily effective in discriminating between microwave signals emanating from satellites spaced as closely together as 2 degrees azimuth.

The antenna system disclosed in FIG. 13 is a two-element array of relatively small conventional parabolic dish antennas including adjustable means for precisely nullifying interfering signals arriving from an azimuthal direction that is only slightly different from the primary receiving direction. The two-element antenna array is mounted generally on an antenna support mount 160 which may be a fixed mount or may be a conventional adjustable antenna amount which permits aiming the antenna system at a particular satellite. Rotatable attachment 162 is connected to support mount 160 at a rotation point 164 comprising a rotation axis 166, aligned with the primary receiving direction of the array and permitting at least 90 degrees of rotation in a fixed plane perpendicular to rotation axis 166. Two parabolic dish receiving antenna elements, identified generally as 168 and 170, are oriented with their parabola's axes parallel to rotation axis 166 and are mounted at opposite ends of rotatable attachment 162, equidistant from rotation point 164. The center-to-center spacing between parabolic dish antenna elements 168 and 170 may, for example, be 43 inches. Antenna elements 168 and 170 comprise, respectively, parabolic reflectors 172 and 174, feedhorns 176 and 178, and LNAs 180 and 182. Feedhorns 176 and 178 and LNAs 180 and 182 may be rotatably mounted on parabolic dish antenna elements 168 and 170 to permit rotation about a respective parabola's axis thereby effecting adjustment of an individual antenna element's polarization. Alternatively, individual antenna elements 168 and 170 may themselves be rotatably mounted on rotatable attachment 162 to permit rotation of an entire antenna element, 168 or 170, about its respective parabola's axis to effect element polarization adjustment. LNAs 180 and 182 are interconnected with signal combiner 184 by means of matched cables 186 and 188. Signal combiner 184 may, for example, comprise a transmission line signal combiner circuit of the type disclosed in FIG. 6. Cable 190 connects to signal combiner 184 for the dual purpose of communicating its composite output signal to a down converter as well as to provide means for conducting dc power to LNAs 180 and 182.

According to principles disclosed herein above, the receiving pattern of the two-element array of FIG. 13 includes an adjustable primary receiving null. The angle between the primary receiving direction and the primary null direction will be minimum for receiving directions disposed in the plane containing the primary receiving direction vector and a line between the center of the two antenna elements. Assuming a center-to-center element spacing of 43 inches, this minimum null angle is two degrees. Accordingly, interfering signals from an undesired satellite which is displaced in azimuth from a desired satellite by 2 degrees will be nullified when the two satellites and the two antenna element centers are all co-planar. If the azimuthal angle between the desired satellite and the undesired satellite is larger than 2 degrees, the interfering signals can still be very effectively nullified by simply rotating the array of FIG. 13 about rotation axis 166.

Figure 14:
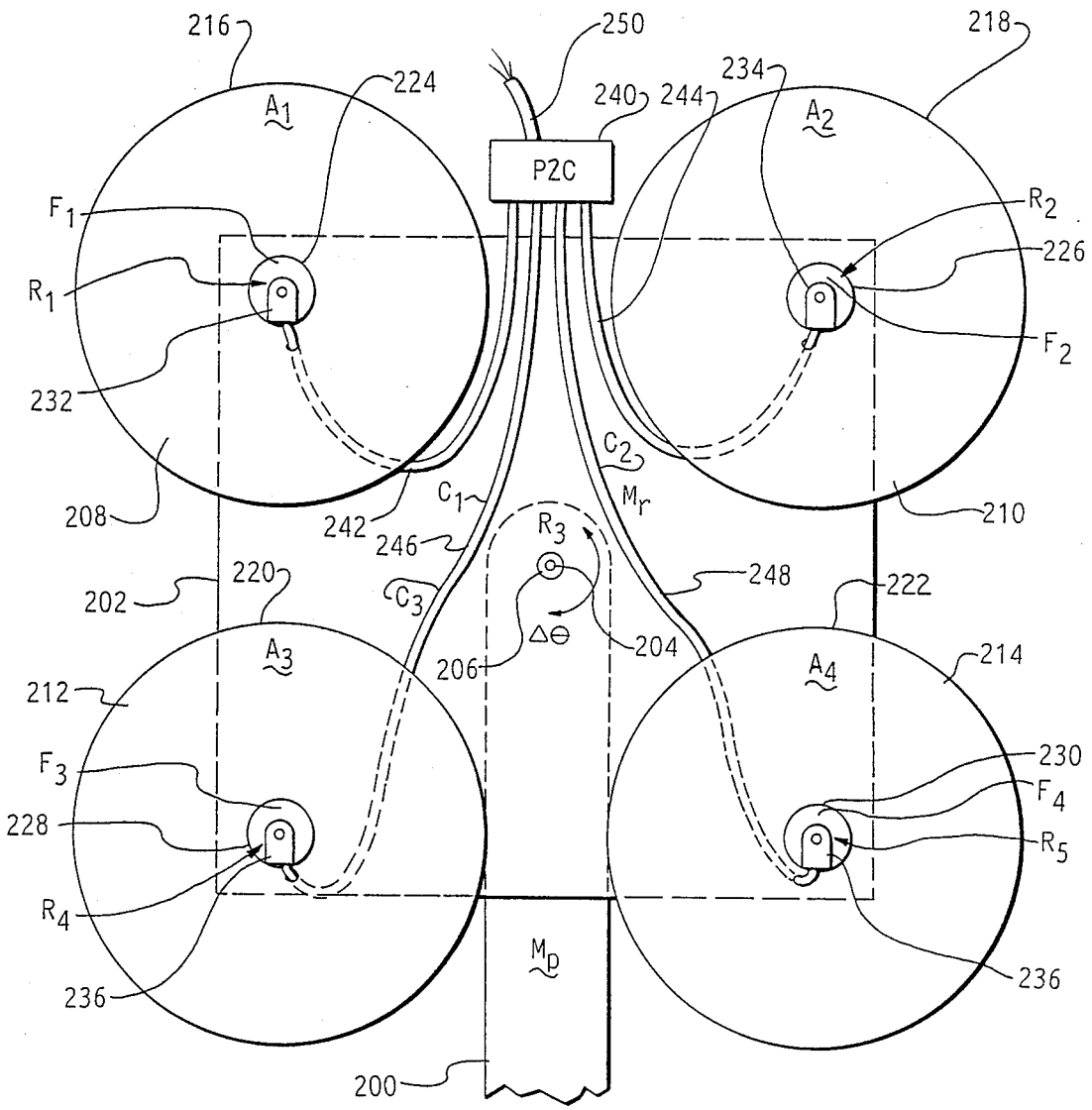
FIG. 14 is an elevational view of a four-element planar receiving antenna array configured in accordance with the present invention.

Referring now to FIG. 14, another practical embodiment of a microwave receiving antenna array in accordance with the present invention will be described in detail. FIG. 14 again discloses a physically small antenna system particularly suitable for TVRO earth station use having capability for adjustably discriminating between microwave signals emanating from satellites spaced as closely together as 2 degrees in azimuth. However, the array of FIG. 14 will additionally provide improvements in both signal to noise ratio and power gain of up to 3 dB in comparison with the array of FIG. 13.

The antenna system disclosed in FIG. 14 is a planar array comprising a four element square array of relatively small parabolic dish antennas. The antenna array is mounted generally on an antenna support mount 200 which may be either a fixed mount or a conventional adjustable antenna mount which permits aiming the antenna system at a particular satellite. Rotatable attachment 202 is attached to support mount 200 at a rotation point 204 comprising a rotation axis 206 permitting at least 45 degrees of rotation in a fixed plane perpendicular to rotation axis 206. Four parabolic dish receiving antenna elements, identified generally as 208, 210, 212, and 214 are oriented with their parabola's axes parallel to rotation axis 206 and are mounted on rotatable attachment 202 equidistant from rotation point 204. The center-to-center spacing between adjacent antenna elements may, for example, be 43 inches. Antenna elements 208, 210, 212, and 214 comprise, respectively, parabolic reflectors 216, 218, 220, and 222, feedhorns 224, 226, 228, and 230, and LNAs 232, 234, 236, and 238. Feedhorns 224, 226, 228, and 230, and LNAs 232, 234, 236, and 238. Feedhorns 224, 226, 228, and 230, and LNAs 232, 234, 236, and 238, may be rotatably mounted on parabolic dish antenna elements 208, 210, 212, and 214 to permit rotation about a respective parabola's axis to effect polarization adjustment. Alternatively, antenna elements 208, 210, 212, and 214 may themselves be rotatably mounted on rotatable attachment 202 to permit rotation of an entire antenna element about the respective parabola's axis to effect polarization adjustment. LNAs 232, 234, 236, and 238 are interconnected with signal combiner 240 by means of matched cables 242, 244, 246 and 248. Signal combiner 240 may, for example, comprise a transmission line signal combiner circuit of the type diclosed in FIG. 12. Cable 250 connects to signal combiner 240 for the dual purpose of communicating its composite output signal to a down converter as well as to provide means for supplying dc power to LNAs 232, 234, 236 and 238.

According to principles disclosed herein above, the receiving pattern of the four-element planar array of FIG. 14 includes discrete primary null directions. The angle between the primary receiving direction and a primary null direction will be minimum for receiving directions disposed in a plane containing the primary receiving direction vector and a line parallel to a side of the square formed by the antenna elements. Assuming a center-to-center spacing of 43 inches between elements at adjacent corners of the square, this minimum null angle is 2.0 degrees. The angle between the primary receiving direction and a primary null direction will be maximum for receiving directions disposed in a plane containing the primary receiving direction and the diagonal of the square formed by the antenna elements. Assuming a center-to-center spacing of 43 inches between elements at adjacent corners of the square, this maximum null angle is 2.83 degrees. Accordingly, intefering signals from an undesired satellite which is displced in azimuth from a desired satellite by either 2.0 degrees or 2.83 degrees can be adjustably nullified by simply rotating the array of FIG. 14 about rotation axis 206. Furthermore, interfering signals from undesired satellites which form azimuthal angles with a desired satellite of between 2.0 and 2.83 degrees can be very effectively minimized by rotation of the array about rotation axis 206. As will be apparent to one having skill in the art, other null angles can be readily obtained by simply changing the center-to-center element spacing.

I have herein disclosed a practical, physically-small, cost-effective, microwave antenna system having capability for discriminating against interfering microwave signals and noise which arrive from an angular direction that is only slightly different from the desired receiving direction. Furthermore, my invention includes adjustable means for precisely nullifying such interfering signals and noise. A particular feature of my invention is its tendency to improve system signal to noise ratio even though the major noise sources are contained within the system before the element signals are combined to form a composite signal. Although only specific embodiments have been described, the general principles disclosed will apply to other geometrical arrangements of elements that will be obvious to one of ordinary skill in the art.

I claim:

1. A microwave receiving antenna array for providing maximum response to incident microwave radiation arriving from a primary receiving direction while rejecting incident microwave radiation arriving from a null-reception direction which differs from said primary receiving direction by only a small angle, comprising:

a plurality of directional antenna elements individually directed in said primary receiving direction and collectively distributed in a symmetrical pattern having a geometric center, said plurality of directional antenna elements disposed in a plane perpendicular to said primary receiving direction, each of said plurality of directional antenna elements providing an electrical output signal representative of a component of said incident microwave radiation;

a plurality of phase-shifting transmission line means having input ends and output ends, said input ends individually operably connected to a respective one of said antenna elements to accept one of said electrical output signals for presenting phase-shifted output signals at said output ends, the phase shifts introduced to said respective electrical output signals by their associated transmission line means being equal;

means for additively combining the phase-shifted output signals at the output ends of said plurality of phase-shifting transmission line means to produce a composite output signal therefrom and for delivering said composite output signal to an output transmission line means, said means for additively combining said phase-shifted output signals including impedance-matching means operably interposed between said plurality of phase-shifting transmission line means and said output transmission line means to effect an impedance match therebetween; and means for collectively rotating said plurality of directional antenna elements about an axis through said geometric center of said symmetrical pattern and parallel to said primary receiving direction thereby adjustably varying said null-reception direction.

2. A microwave receiving antenna as claimed in claim 1, said plurality of directional antenna elements comprising an even number of identical directional antenna elements.

3. A microwave receiving antenna array as claimed in claim 2, wherein said even number of identical directional antenna elements comprises two identical directional antenna elements.

4. A microwave receiving antenna array as claimed in claim 2, wherein said symmetrical pattern comprises a distribution of equally spaced directional antenna elements in a straight line.

5. A microwave receiving antenna array as claimed in claim 2, wherein said even number of identical directional antenna elements comprises four identical directional antenna elements and said symmetrical pattern comprises a distribution of said elements at corners of a regular tetrahedron.

6. A microwave receiving antenna array as claimed in calim 5, wherein said regular tetrahedron is a square.

7. A microwave rceiving antenna array as claimed in claim 2, wherein said even number of identical directional antenna elements comprises four identical directional antenna elements and said symmetrical pattern comprises a distribution of said elements at corners of a rectangle.

8. A microwave receiving antenna array as claimed in claim 1, said plurality of directional antenna elements comprising a plurality of parabolic reflector antenna elements, each one of said plurality of paraboilic reflector antenna elements having a polarization direction, including adjustable means for individually rotating said polarization direction of each one of said plurality of parabolic reflector antenna elements about an axis parallel to said primary receiving direction to maximize response to incident microwave radiation arriving from said primary receiving direction.

9. A microwave receiving antenna array as claimed in claim 1, wherein each one of said plurality of directional antenna elements includes a low-noise amplifier means and said electrical output signal representative of a particular component of said incident microwave radiation received by said one of said plurality of directional antenna elements is an amplified signal.

10. A microwave receiving antenna array as claimed in claim 1, wherein said means for additively combining said phase-shifted signals comprises parallel connection means and said impedance-matching means comprises quarter-wavelength transmission line means.

11. A microwave receiving antenna array for providing maximum response to incident microwave radiation arriving from a primary receiving direction while rejecting incident microwave radiation arriving from a null-reception direction which differs from said primary receiving direction by only a small angle, comprising:

identical first and second parabolic reflector antenna elements individually directed in said primary receiving direction and collectively disposed in a plane perpendicular to said primary receiving direction, each one of said first and second parabolic reflector antenna elements having a polarization direction and each one of said first and second parabolic reflector antenna elements including a low-noise amplifier means providing an electrical output signal representative of the amplified component of said microwave radiation received by the associated one of said first and second parabolic reflector antenna elements;

first and second phase-shifting transmission line means having input and output ends, respective ones of said input ends operably connected to a respective one of said antenna elements to accept one of said electrical output signals for presenting phase-shifted output signals at said output ends, the phase-shifts introduced to said respective electrical output signals by their associated transmission line means being equal;

means for additively combining said phase-shifted output signals at said output ends of said first and second phase-shifting transmission line means to produce a composite output signal therefrom and for delivering said composite output signal to an output transmission line means, said means for additively combining and delivering including impedance-matching means operably interposed between said first and second phase-shifting transmission line means and said output transmission line means to effect an impedance match therebetween;

means for individually rotating said polarization direction of said first and second parabolic reflector antenna elements about an axis parallel to said primary receiving direction to maximize response to incident microwave radiation arriving from said primary receiving direction; and means for collectively rotating said first and second parabolic reflector antenna elements about an axis through a point half-way between said elements and parallel to said primary receiving direction to adjustably vary said null-reception direction therewith.

12. A microwave receiving antenna array as claimed in claim 11 wherein said means for additively combining said phase-shifted signals comprises a parallel connection and said impedance-matching means comprises a quarter-wavelength transmission line.

13. A method for receiving incident microwave radiation from a primary receiving direction while rejecting incident microwave radiation from an adjustable null-reception direction differing from said primary receiving direction by a small angle comprising the steps of:

symmetrically arranging a plurality of directional antenna elements about a geometric center point in a common plane perpendicular to said primary receiving direction, each individual one of said plurality of directional antenna elements providing an output signal at a particular impedance level;

directing each individual one of said plurality of directional antenna elements in said primary receiving direction;

phase-shifting each said output signal by an equal amount to provide a plurality of equally phase-shifted output signals having a common impedance level;

combining said plurality of equally phase-shifted output signals and transforming said common impedance level to form a single composite output signal at an output impedance level;

coupling said single composite output signal to an output transmission line having a characteristic impedance which matches said output impedance level; and collectively rotating said plurality of directional antenna elements about an axis through said geometric center point and parallel to said primary receiving direction to adjust said adjustable null direction thereby.

14. A method for receiving incident microwave radiation as in claim 13 wherein said directional antenna elements comprise parabolic reflector antenna elements having polarization directions and said method further includes the step of adjustably rotating each one of said polarization directions about an axis parallel to said primary receiving direction to maximize response to incident microwave radiation arriving from said primary receiving direction.

* * * * *

UNITED STATES PATENT AND TRADEMARK OFFICE

CERTIFICATE OF CORRECTION

PATENT NO. : 4,791,428

DATED : December 13, 1988

INVENTOR(S) : Keith V. Anderson

It is certified that error appears in the above-identified patent and that said Letters Patent is hereby corrected as shown below:

Column 4, line 25, delete the word "an" and substitute therefor --and--.

Column 5, line 48, delete the word "preferaebly" and substitute therefor --preferably--.

Column 6, line 21, delete the word "an" and substitute therefor --and--.

Column 7, line 12, delete the word "Ø" and substitute therefor --θ--.

Column 8, line 53, delete the word "z-zxis" and substitute therefor --z-axis--.

Column 11, line 63, delete the word "amount" and substitute therefor --mount--.

Column 13, lines 11-12, delete the words "Feedhorns 224, 226, 228, and 230, and LNAs 232, 234, 236, and 238."

UNITED STATES PATENT AND TRADEMARK OFFICE

CERTIFICATE OF CORRECTION

PATENT NO. : 4,791,428

DATED : December 13, 1988

INVENTOR(S) : Keith V. Anderson

It is certified that error appears in the above-identified patent and that said Letters Patent is hereby corrected as shown below:

Column 13, line 25, delete the word "diclosed" and substitute therefor --disclosed--.

Column 13, line 49, delete the word "displced" and substitute therefor --displaced--.

Signed and Sealed this

Second Day of May, 1989

*Attest:*

*Attesting Officer*

DONALD J. QUIGG

*Commissioner of Patents and Trademarks*